US008651064B2

(12) United States Patent
Paine

(10) Patent No.: US 8,651,064 B2
(45) Date of Patent: Feb. 18, 2014

(54) CONTROL SYSTEM FOR A BOILER ASSEMBLY

(71) Applicant: Lochinvar, LLC, Lebanon, TN (US)

(72) Inventor: John C. Paine, Brentwood, TN (US)

(73) Assignee: Lochinvar, LLC, Lebanon, TN (US)

( * ) Notice: Subject to any disclaimer, the term of this patent is extended or adjusted under 35 U.S.C. 154(b) by 0 days.

(21) Appl. No.: 13/734,462

(22) Filed: Jan. 4, 2013

(65) Prior Publication Data

US 2013/0126627 A1 May 23, 2013

Related U.S. Application Data

(62) Division of application No. 12/112,179, filed on Apr. 30, 2008, now Pat. No. 8,371,252.

(51) Int. Cl.
*F22D 5/00* (2006.01)

(52) U.S. Cl.
USPC ..... 122/1 R; 122/448.3; 237/8 A; 237/8 D

(58) Field of Classification Search
USPC ..... 122/1 R, 446, 448.3; 237/8 A, 8 D; 700/19, 20, 275, 282, 300
See application file for complete search history.

(56) References Cited

U.S. PATENT DOCUMENTS

| | | | | |
|---|---|---|---|---|
| 4,542,849 | A | 9/1985 | Pichot et al. | |
| 4,598,668 | A | 7/1986 | Bader | |
| 4,723,513 | A | 2/1988 | Vallett et al. | |
| 4,793,800 | A | 12/1988 | Vallett et al. | |
| 4,852,524 | A | 8/1989 | Cohen | |
| 4,860,696 | A | 8/1989 | Fujita | |
| 5,042,431 | A | 8/1991 | Shprecher et al. | |
| 5,881,681 | A | 3/1999 | Stuart | |
| 5,989,020 | A | 11/1999 | Glass et al. | |
| 6,428,312 | B1 | 8/2002 | Smelcer | |
| 6,619,951 | B2 | 9/2003 | Bodnar et al. | |
| 6,694,926 | B2 | 2/2004 | Baese et al. | |
| 6,745,085 | B2 | 6/2004 | Pouchak | |
| 7,658,335 | B2 * | 2/2010 | Johnson, Jr. | 237/8 R |
| 8,271,143 | B2 * | 9/2012 | Deivasigamani et al. | 700/282 |
| 8,479,689 | B2 * | 7/2013 | Pitonyak et al. | 122/448.3 |
| 2002/0193890 | A1 | 12/2002 | Pouchak | |
| 2007/0209653 | A1 | 9/2007 | Beisheim et al. | |
| 2007/0295830 | A1 | 12/2007 | Cohen et al. | |
| 2013/0099014 | A1 * | 4/2013 | Kovalcik et al. | 237/8 A |

OTHER PUBLICATIONS

Exhibit A: KNIGHT XL Commercial Boiler Brochure, Lochinvar Corporation, Lebanon, Tennessee (undated but admitted to be prior art per paragraphs [0003]-[0004] of the specification).

* cited by examiner

*Primary Examiner* — Gregory A Wilson
(74) *Attorney, Agent, or Firm* — Waddey & Patterson, P.C.; Lucian Wayne Beavers

(57) ABSTRACT

A control system for managing and interfacing a plurality of water heaters, e.g. boilers. The control system includes a first boiler unit controlled by a first boiler control unit and a second boiler unit controlled by a second boiler control unit. The first boiler control unit is operable to coordinate the operation of the first and second boiler units in response to changes in output demand. The flues of the first and second boiler units are connected to a common flue. The control system further includes an interface and an interface control system. The interface control system communicates requests from the interface, to report and/or alter the operating parameters of the first and second boiler units, to the first and second boiler control units and communicates the request outcome(s) back to the interface.

9 Claims, 14 Drawing Sheets

CONTROL SYSTEM FOR A BOILER ASSEMBLY

BACKGROUND OF THE INVENTION

1. Field of the Invention

The present invention relates generally to boilers or heaters for heating water, and more particularly, but not by way of limitation, to a control system for managing and interfacing a plurality of boilers.

2. Description of the Prior Art

To service facilities having significant demand for heat input into the water supply system, it is well-known in the prior art to employ multiple water heating units, working with coordinated efforts, to satisfy the demand. One such prior art water heating system is based on the KNIGHT™ XL, which has been marketed by Lochinvar Corporation, the assignee of the present invention. The KNIGHT XL features SMART SYSTEM™, which coordinates the operation of a group of individual KNIGHT XL water heating units so that the individual units may function, in concert, to supply heat input into a water supply system.

Specifically, the SMART SYSTEM includes a cascading sequencer. SMART SYSTEM selects one water heating unit as the leader. Provided the heat input demand is less than the capacity of the leader, SMART SYSTEM modulates the operation of the leader to match the heat input demand (water heaters having continuously variable outputs over a range of outputs are well known in the prior art, exemplary systems include those disclosed in U.S. Pat. No. 4,852,524 to Cohen, U.S. Pat. No. 5,881,681 to Stuart, and U.S. Pat. No. 6,694,926 to Baese et al.). If the heat input demand exceeds the capacity of the leader, SMART SYSTEM activates a second water heating unit to handle the excess heat input demand, i.e. the heat input demand above the capacity of the leader "cascades" to the second water heating unit. Keeping the output of the leader at a constant output level, SMART SYSTEM then modulates the operation of the second water heating unit according the excess heat input demand. If the heat input demand exceeds the combined capacity of the leader and the second water heating unit then cascading continues as additional water heating units activate in sequence until enough units are in operation to satisfy the heat input demand. Conversely, when the heat input demand decreases, SMART SYSTEM reverses the cascading process.

Rather than operate the individual water heating units in a cascaded configuration as described above, other prior art water heating control systems employ different schemes. For example, one prior art scheme operates a first water heater in a predetermined range, a range less than the operational limits of the water heater. When the input heat demand causes the first water heater to exceed the predetermined range, a second water heater is activated. The first and second water heaters are then operated in the predetermined range until the heat input demand causes the first and second water heaters to operate outside of the range. When this happens a third water heater is activated and the first, second, and third water heaters operate in the predetermined range. This process continues as additional water heaters are needed to satisfy the input heat demand. The aim of this scheme is to keep the water heaters operating in the predetermined range.

Whether the need to operate a group of individual water heating units as a single system arises from efficiency concerns or the inability of a single water heating unit to meet the heat input demand of a water supply system, the implementation of control systems capable of effectively interfacing and managing the coordinated operation of multiple water heating units is of great import. Without effective management and coordination, the collection of individual water heating units may operate inefficiently or simply fail to satisfy the input heat demands of a water supply system. Further, the absence of adequate interfacing, i.e. communication with and monitoring of the heating system, may result in delays when responding to events that require attention, such as fault conditions or adjusting the system's operating parameters. It is these problems at which the present invention is directed.

SUMMARY OF THE INVENTION

The present invention provides a control system for managing and interfacing a plurality of modulating water heaters or boilers. Specifically, the present invention provides a control system capable of coordinating the operation of a boiler assembly. A boiler assembly has at least one boiler system, the boiler system having first and second boiler units in a common boiler housing. Each boiler unit includes a boiler control unit and a flue connected to a common flue. The first and second boiler control units direct the operation of the first and second boiler units, respectively. Further, the first boiler control unit not only directs the operation of the first boiler unit but also communicates with the second boiler control unit and coordinates the operation of the two boiler units.

The control system of the present invention allows the first boiler control unit to modulate the output of the first boiler unit in response to the input heat demand. Moreover, if the input heat demand exceeds the first boiler unit's capacity, the first control unit may direct the second boiler unit to fire. Once both the first and second boilers have fired, the first boiler control unit modulates the first and second boiler units to satisfy the input heat demand while maintaining comparable outputs between the two boiler units.

One problem associated with the firing of the second boiler unit, as described above, involves ignition blowout. Consider that when the control system of the present invention determines that the second boiler unit must be called into service, because the input heat demand exceeds the maximum output of the first boiler unit, the blower assembly of the first boiler unit is operating near its threshold. The back pressure generated by the blower assembly poses an obstacle to successfully firing the second boiler assembly because the two boilers are connected to a common flue. To minimize the occurrence of ignition blowout of the second boiler unit, the present invention, via the first boiler control unit, causes the blower assembly of the first boiler unit to operate in a reduced blower speed range. Operating the blower assembly in this range facilitates the ignition process of the second boiler unit. After the second boiler has been fired, the boiler unit(s) may resume normal operation.

The present invention also provides an interface and an interface control system. The interface control system is coupled to and communicates with the interface, the first boiler control unit, and the second boiler control unit. The interface may be a device such as a LCD touch screen. The interface permits an external source, for example a user, to request reports about the operation of the first and second boiler units and/or to change the operating parameters of the units, e.g. boiler set points. The interface may have a plurality of different screens, user-selectable, for reporting and/or altering the operating parameters of the boiler system. The interface control system communicates the inputs from the interface to the first and second control units and conveys information from the first and second control units to the interface for display.

The control system of the present invention also provides for the control and coordination of multiple boiler systems, each system having a common housing and two boiler units, arranged for control in a cascade sequence. With this configuration, the control system operates as follows: after the first and second boiler units have reached their maximum output, and while sustaining the output, the first boiler control unit fires a third boiler unit, located in a second boiler housing, and modulates the output of the third boiler in response to the input heat demand. If the input heat demand exceeds that available from the first, second, and third units, the first control units fires a fourth boiler unit, also located in the second boiler housing. As with the first and second boiler units, once the third and fourth boiler units have both fired, the first boiler control unit functions to achieve comparable third and fourth boiler unit outputs, while maintaining the outputs of the first and second boiler units at or near capacity.

The interface control system is also capable of communicating with the third and fourth boiler control units, via the first boiler control unit, to report the operating parameters of the third and fourth boiler units, in addition to the first and second units, to the interface. Thus, the interface control system and the interface work to provide a central mechanism from which the boiler assembly can be monitored and operated. In this way the control system of the present invention serves to manage and interface multiple boiler systems having multiple boiler units arranged in a cascade configuration.

Accordingly, it is an object of the present invention to provide a control system capable of coordinating the operation of a boiler system having multiple boiler units in a common housing.

Another object of the present invention is to provide a control system for multiple boiler systems, each boiler system having multiple boiler units, configured in a cascade arrangement.

And another object of the present invention is to provide an interface to the boiler assembly to monitor and alter the operation of the boiler assembly.

Still another object of the present invention is to provide a method for controlling a boiler system with more than one boiler unit.

Other and further objects features and advantages of the present invention will be readily apparent to those skilled in the art upon a reading of the following disclosure when taken in conjunction with the accompanying drawings.

DETAILED DESCRIPTION OF THE PREFERRED EMBODIMENTS

The control system of the present invention operates on water heaters or boilers. As used herein, the term water heater refers to a device for heating water, including water heaters that do not actually "boil" the water. Much of this discussion refers to a boiler, but it will be understood that this description is equally applicable to water heaters that do not boil the water.

Boiler Assembly Structure/Arrangement

Figure 1:
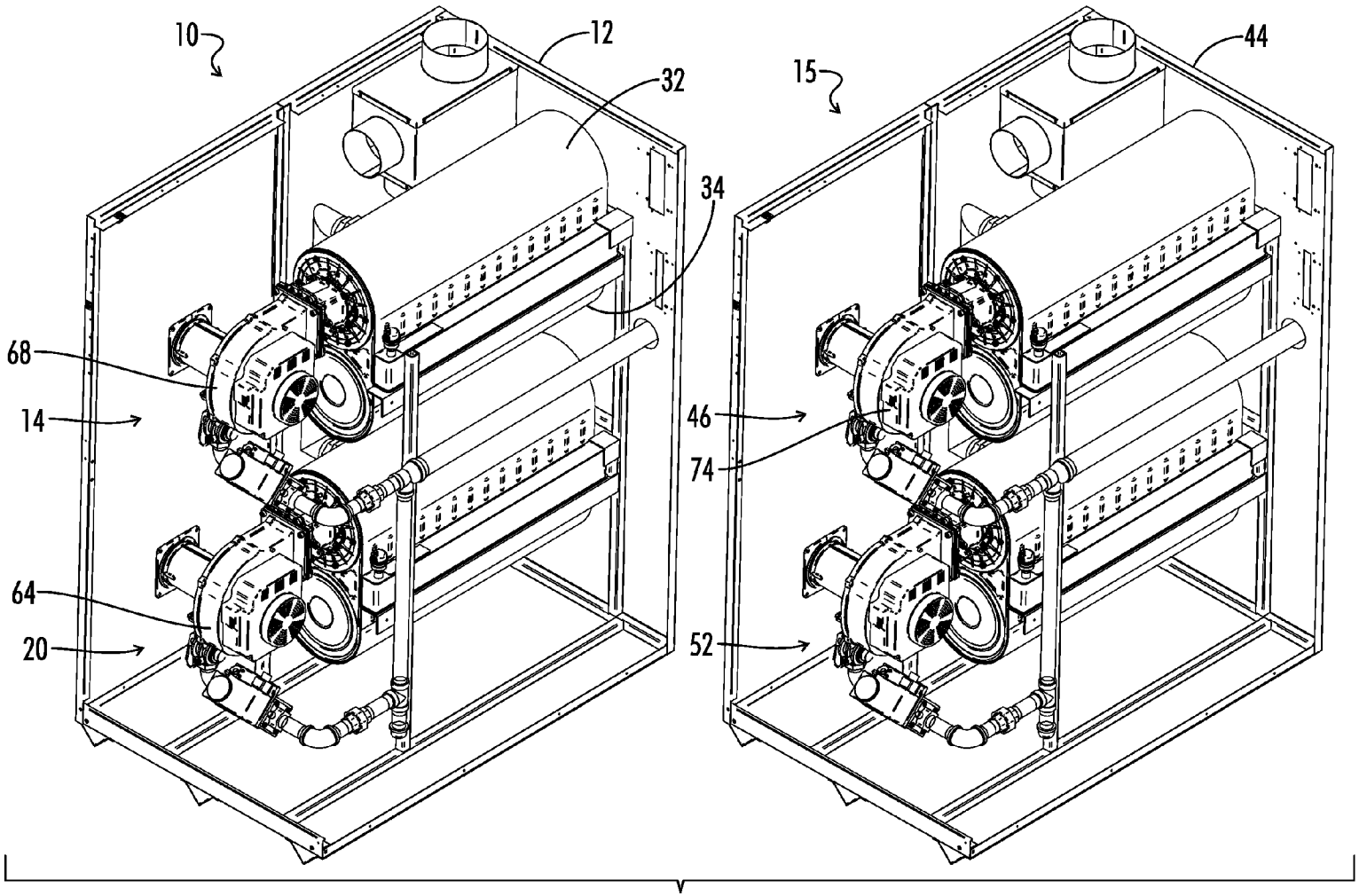
FIG. 1 is a perspective view of a first and second boiler system, each boiler system having two boiler units. A portion of each external boiler housing is removed in FIG. 1.
Figure 2:
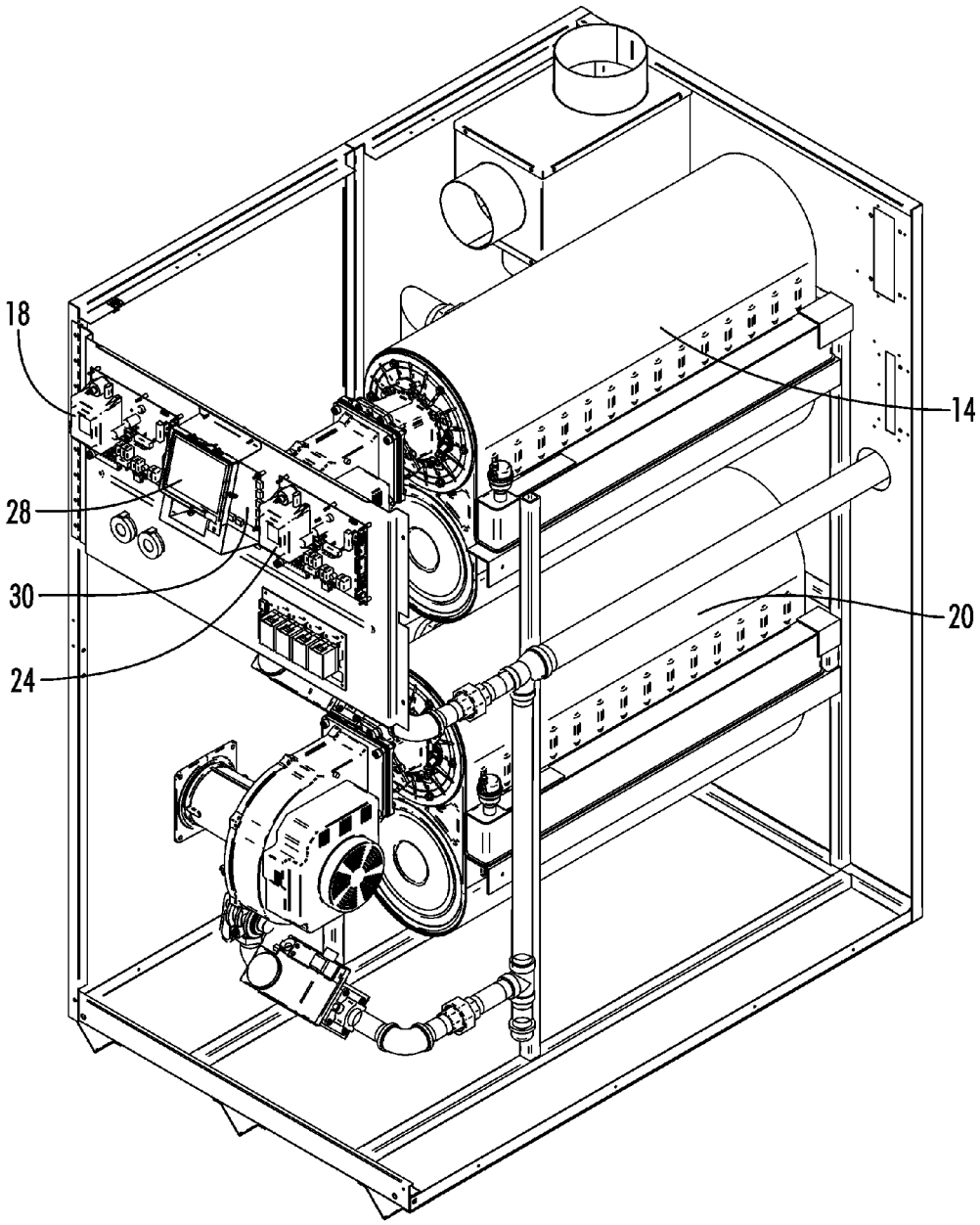
FIG. 2 is a perspective view of a boiler system with a portion of the boiler housing removed to reveal an interface control system and an interface.
Figure 9:
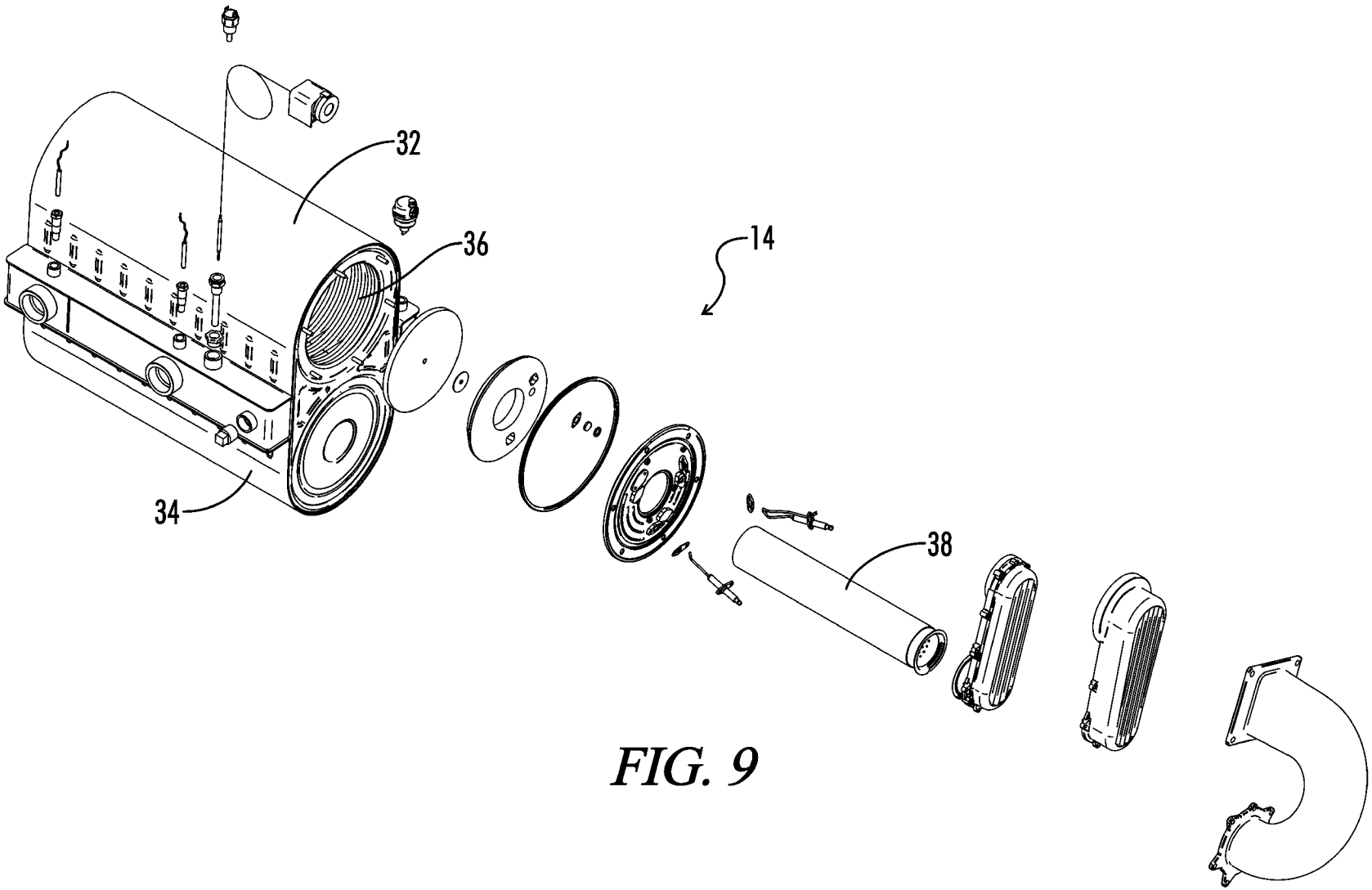
FIG. 9 is an exploded view of a heat exchanger and a burner tube.

Now referring to the figures, FIG. 1 shows a boiler system, a boiler system can be described as an apparatus that has at least two boiler units contained in a common boiler housing. Specifically, FIG. 1 depicts a first boiler system 10 with a first boiler unit 14 and a second boiler unit 20 located in a first boiler housing 12. FIG. 9 shows an exemplary embodiment of the first boiler unit 14, more specifically a partially disassembled first boiler unit 14. The basic architecture of the exemplary embodiment of the first boiler unit 14 includes: a primary heat exchanger 32 located in parallel above a secondary horizontally-oriented heat exchanger 34, an elongated burner tube 38 or first burner 38 extending axially into the combustion chamber 36, and a variable speed pre-mix blower or first boiler blower assembly 68 (shown in FIG. 1) located proximate the combustion chamber 36 for providing a fuel-air mixture to the burner 38 at variable flow rates.

In operation, the fuel-air mixture is delivered to the first burner 38 where it is ignited to start the combustion process. Water is then passed through the primary and secondary heat exchangers 32 and 34 where it is warmed by the combustion process. The warmed water is delivered to a water supply system to satisfy an input heat demand from that system. The exhaust gases resulting from the combustion process are directed and expelled out of the first flue gas exit 16, shown in FIG. 10. The above-described boiler architecture is for exemplary purposes only, the present invention envisions other boiler or water heater architectures, such as, but not limited to, copper fin water heaters, condensing water heaters, non-condensing water heaters, and those disclosed in U.S. Pat. No. 4,852,524 to Cohen, U.S. Pat. No. 5,881,681 to Stuart, and U.S. Pat. No. 6,694,926 to Baese et al., all of which are incorporated herein by reference.

Figure 10:
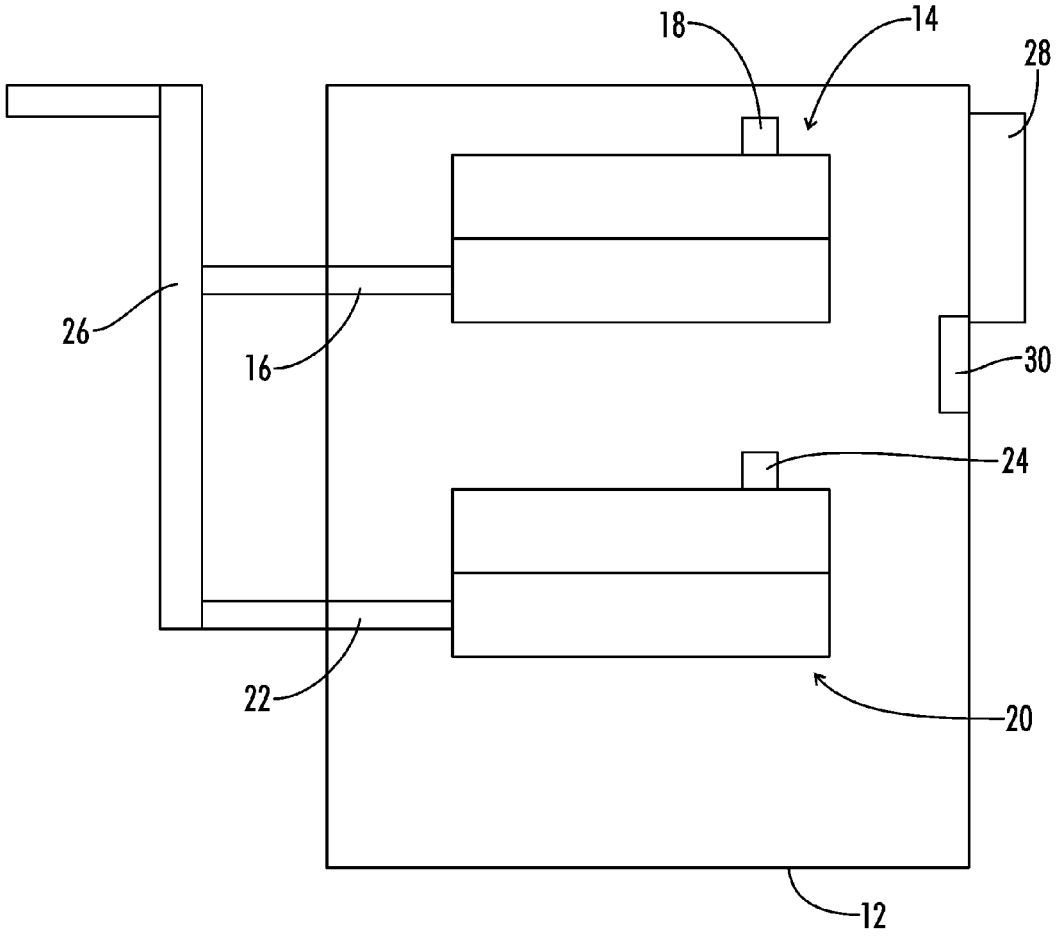
FIG. 10 is a side schematic view of the first boiler system of FIG. 1.

Referring to FIG. 10, the first boiler unit 14 includes a first flue gas exit 16, a first boiler control unit 18, and first boiler operating parameters. The first boiler control unit 18 controls the operation of the first boiler unit 14. In one preferred embodiment, the first boiler control unit 18 is comprised of a plurality of electrical circuits capable of sensing and manipulating the operation of the first boiler unit 14. The first boiler control unit 18 may be mounted inside or outside of the first boiler housing 12. If the control unit 18 is mounted inside of the housing 12, the components constituting the control unit 18 should be temperature rated to withstand the operating environment.

To effectively control the operation of the first boiler unit 14, the first boiler control unit 18 may monitor conditions such as the inlet water temperature to the boiler unit 14, the outlet water temperature (the water temperature after the boiler unit 14 has heated the water entering the boiler unit 14) the water temperature of the system to which the boiler unit 14 is coupled, the speed/state of the blower assembly 68, the burner flame, the flue temperature, the tank temperature, fuel/air mixture or flow rate, the output at which the boiler unit 14 is currently operating relative to the boiler unit's maximum output (via the speed of the blower assembly 68, fuel/air mixture or flow rate, water flow rate, etc.), outside temperature, the heat exchanger pump settings, the system pump settings, etc. Although, not an exhaustive list or a necessary one, these metrics allow the first boiler control unit 18 to assess the state of the first boiler unit 14. Thus, the first boiler control unit 18 monitors an array of sensors, and/or other inputs, to regulate the operation of the first boiler unit 14.

The first boiler operating parameters describe the set of instructions which guide the first boiler control unit 18 during its operation of the first boiler unit 14. For example, the instructions may include a set point that fixes the desired temperature of water output from the first boiler unit 14. The first boiler operating parameters may also describe the current state of the first boiler unit 14, which the first boiler control unit 18 must know to properly operate the first boiler unit 14 in response to changes in the input heat demand, changes in the set point(s), or simply to maintain the boiler's current state.

The first boiler system 10 further includes a second boiler unit 20 having a second flue gas exit 22, a second boiler control unit 24 and second boiler operating parameters, as shown in FIG. 10. The discussion and description of the second boiler unit 20, and its constituent parts, is similar to that already presented with reference to the first boiler unit 14 and no further elaboration is necessary. However, it should be noted that the orientation and configuration of the boiler units 14 and 20 is not critical (neither the exemplary embodiment described in FIG. 9 nor the orientation depicted in FIG. 10 is crucial to the operation of the invention). Rather, their coordinated operation as directed by the first boiler control unit 18, discussed in detail below, is one of several defining attributes.

The present invention also includes a first common flue 26 connected to both the first and second flue gas exits 16 and 22, as shown in FIG. 10. The first common flue 26 serves to channel the spent combustion gases out of the boiler units 14 and 20. The first common flue 26 may be inside or outside the boiler housing 12. Further, the first flue gas exit 16 may simply join the second flue gas exit 22, or vice versa, to form the first common flue 26.

To monitor and adjust boiler system settings, the present invention provides a first interface 28. The first interface 28 allows, for example, a user to access information about the first boiler system 10 such as the first and second boiler unit operating parameters. The first interface 28 also permits certain operating parameters to be altered. Thus, if the user desired to change a set point for the first boiler unit 14, the user could do so via the first interface 28.

In one preferred embodiment, the interface 28 is an LCD touch screen device 28 or control panel 28. Moreover the panel 28 may have a plurality of user selectable screens, such as those shown in FIGS. 4*a*-4*d*.

Figure 4A:
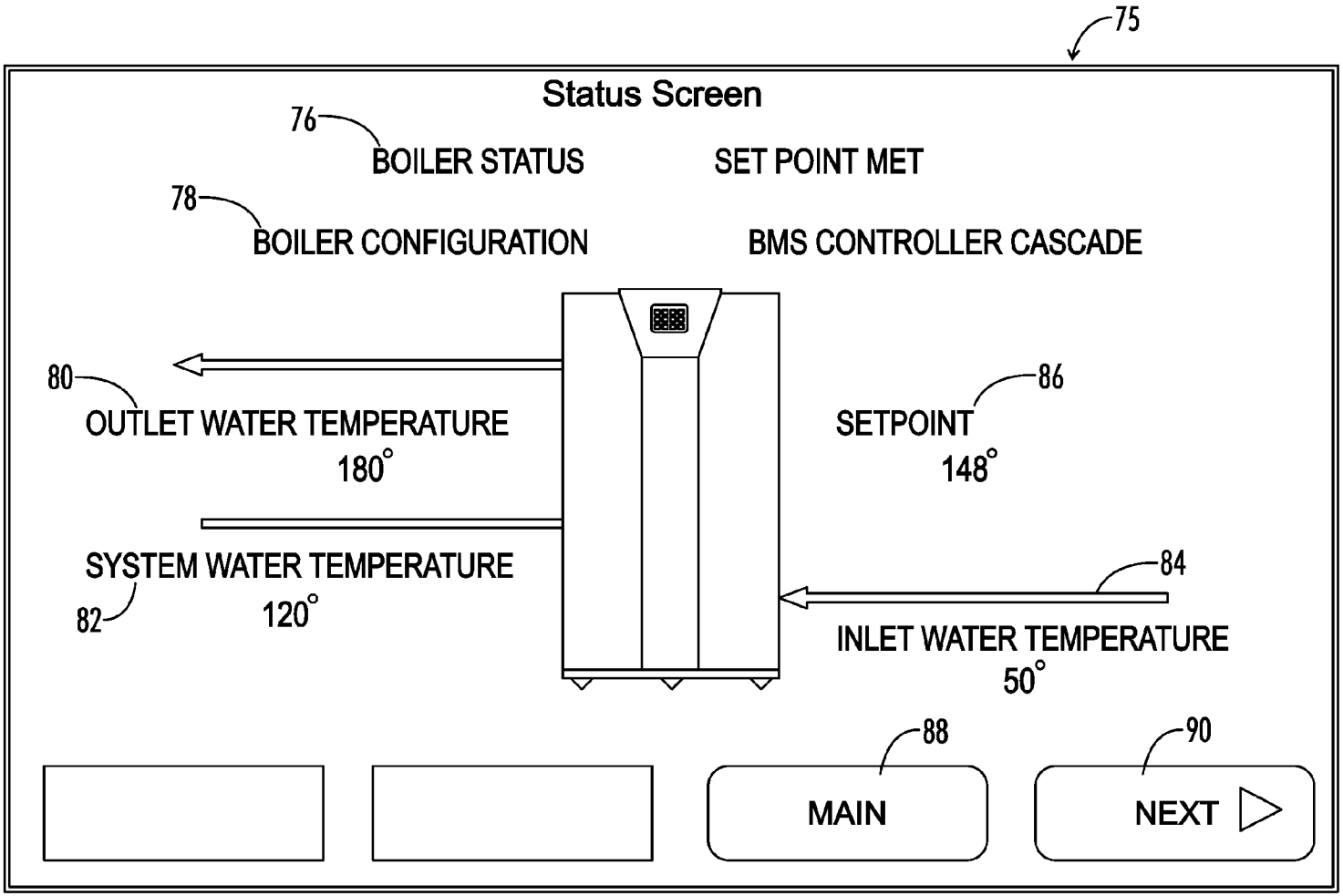
FIGS. 4*a*-4*d* are exemplary screen shots displayable on the interface.

For instance, FIG. 4*a* presents an exemplary Status screen 75 reflecting the operation of the first boiler system 10. Specifically, FIG. 4*a* shows the boiler status 76. The boiler status 76 indicates whether the set point 86 has been met. In one embodiment, the set point 86 may be described as the desired temperature setting for the water supply system. The status screen may also include the boiler configuration 78. The boiler configuration 78 describes the operational arrangement of the boiler system. In this exemplary screen shot the boiler configuration is BMS Controlled Cascade, indicating that the boiler units are in a cascaded configuration and that a building management system (BMS) is overseeing the operation of the boiler system. The outlet water temperature 80 gives information about the water provided from the boiler system 10 to the water supply system. The system water temperature 82 reflects the current water temperature of the water supply system and is used to assist the boiler system 10 in determining its mode of operation. The inlet water temperature 84 describes the water temperature of the water entering the boiler system 10, prior to being heated/warmed. The Status screen 75 also allows the user to go back to the Main screen 92 by selecting the Main button 88 and to proceed to another screen by selecting the Next button 90.

Figure 4B:
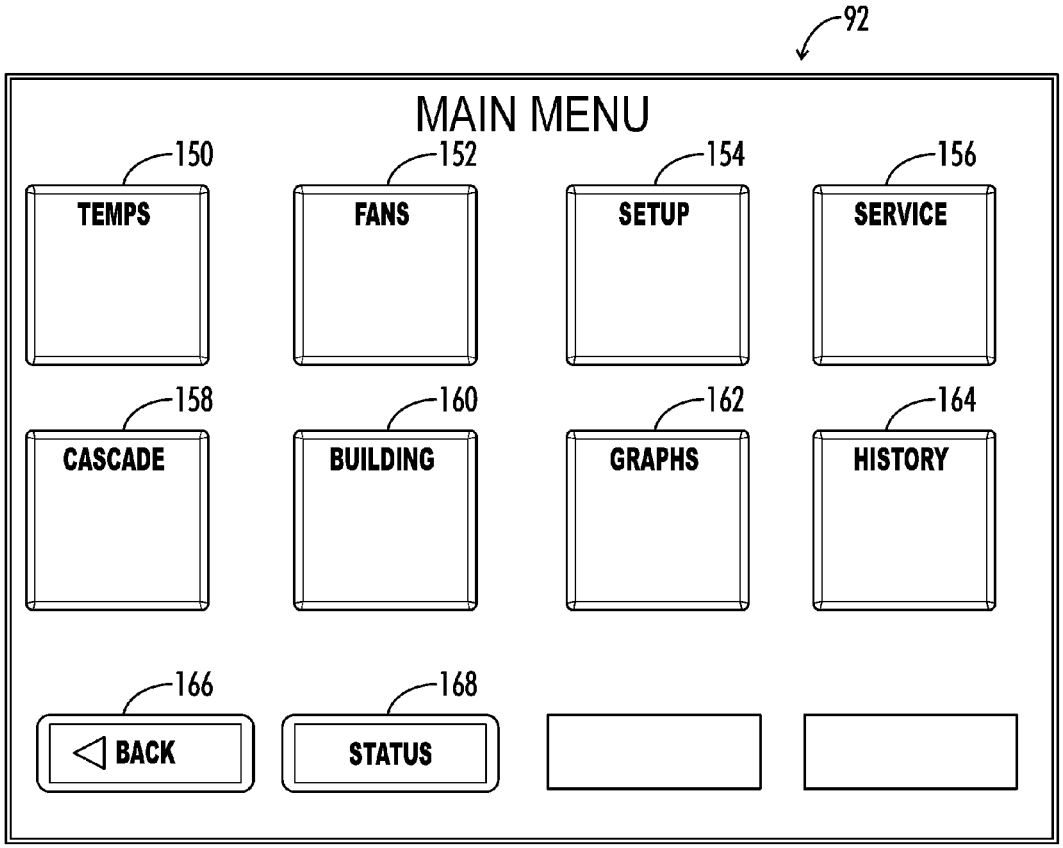

FIG. 4*b* is an exemplary screen shot of a Main menu 92, the Main menu 92 is accessible, among others, by selecting the Main button 88 on the Status screen 75 depicted in FIG. 4*a*. The Main menu 92 also includes options to view screens providing the following information: temperatures in the system 150, fan/blower assembly operation 152, setup of the system 154, service/maintenance information 156, operational descriptions of boiler units/system in the cascade (if any) 158, information about the building to which the boilers are providing service 160, graphs pictorially depicting data about the boiler system 162, and the operational history of the system 164. Further the Main menu 92 also provides a means to navigate to the Status screen 75 via button 168 and a means to navigate back to the previous screen via button 166.

Figure 4C:
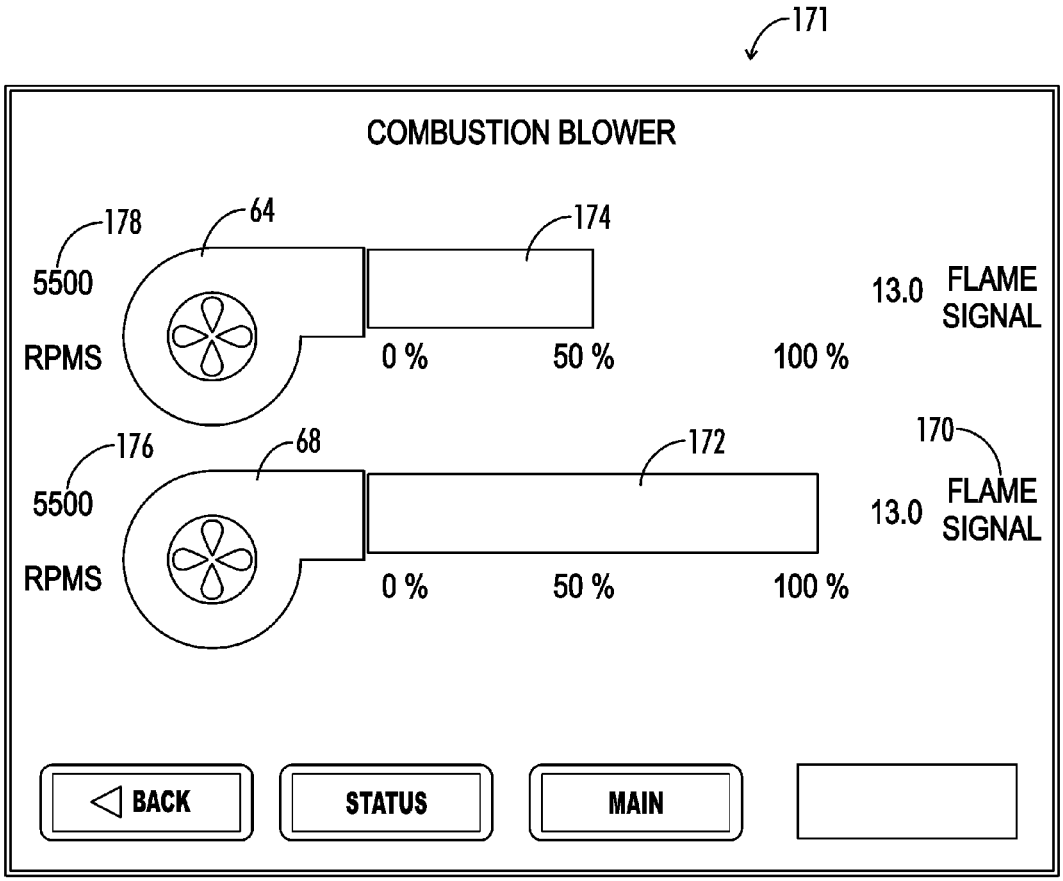

FIG. 4*c* presents an exemplary screen shot, Combustion Blower 171, detailing the performance of the first and second boiler blower assemblies 68 and 64 and a flame signal status 170 associated with each of the first and second burners 38 and 66. In this embodiment, the presence of "Flame Signal" next to the first boiler blower assembly 68 indicates that the first burner 38 has been fired. The absence of "Flame Signal" next to the second boiler blower assembly 64 indicates that the second burner 66 has not been fired. The screen shot 171 also reports the capacity at which the boiler blower assemblies are operating, as shown in graphs 172 and 174. From these graphs 172 and 174 it can be seen that the first boiler blower assembly is operating at 100% capacity and the second boiler blower assembly is operating at 50% capacity. Also shown is the revolutions per minute (RPM) of each blower assembly, first and second RPM indicators 176 and 178. The screen shot 171 provides a Back button 180 to navigate to the previous screen, a Status button 182 to navigate to the Status screen 75, and a Main button 184 to navigate to the Main screen 92.

Figure 4D:
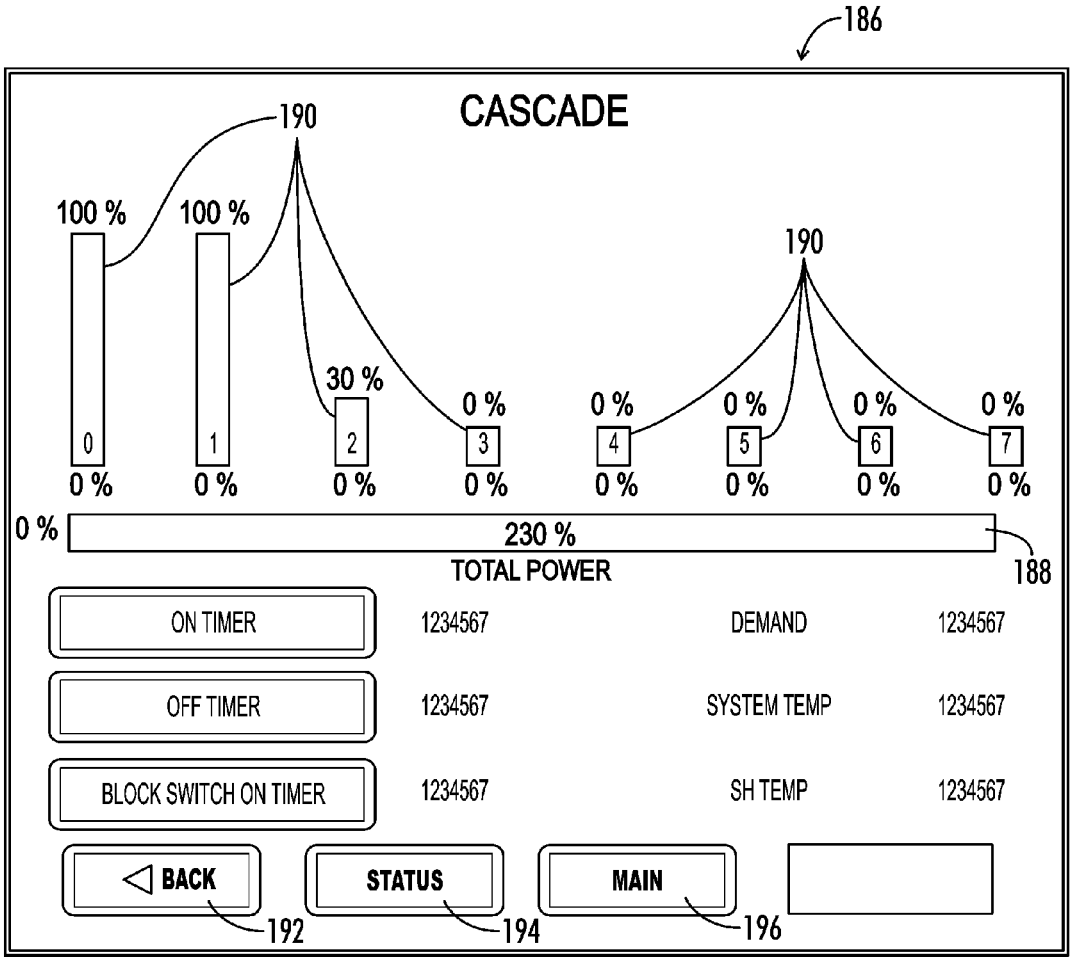

Importantly, and as depicted in FIG. 4*d*, the first interface 28 is capable of showing information from one or both boiler units 14 and 20 via a Cascade screen 186. The Cascade screen 186 discloses the total power 188 generated by the cascade and the power contribution from each boiler unit 190. The Cascade screen 186 also provides a Back button 192 to navigate to the previous screen, a Status button 194 to navigate to the Status screen 75, and a Main button 196 to navigate to the Main screen 92.

As already noted, the first interface 28 is operable to accept inputs from a user to alter the performance of the first boiler system 10 through changes in set points or other operational parameters. One advantageous aspect of the LCD touch screen control panel 28 is its ability to graphically depict the data/information—this often makes the data more easily digestible and expedites decision making processes based on that data/information.

The first interface 28 is not limited to a LCD touch screen 28, in some embodiments the first interface 28 may be a computer 28, a laptop 28, or a text-only display with or without a keyboard-type device. Regardless of the particular embodiment, the first interface 28 serves to provide information about the operation of the first boiler system 10 and, in some instances, alter the operating parameters of the system 10.

To convey information between the first boiler unit 14 and/or the second boiler unit 20 and the first interface 28, the present invention employs a first interface control system 30. The first interface control system 30 communicates information between the boiler units 14 and 20 and the first interface 28. This may require both formatting, i.e. interpreting, and routing the communications. Thus, for example, when a user inputs a request, via the first interface 28, to display a set point of the first boiler unit 14, the first interface control system 30 may both direct the request to the first boiler control unit 18 and package the request so that it is interpretable by the control unit 18. In response to the request, the first boiler control unit 18 may then reply, via the first interface control system 30, to allow the first interface 28 to display the information requested by the user.

However, these may not always be two distinct steps (directing and interpreting the communication). In some embodiments, the first interface 28 and the boiler units 14 and 20 may utilize the same or similar communications protocols and/or data frame formats and, if such a scenario exists, the first interface control system 30 functions more like a gateway between the sender and receiver. Moreover, in the preferred embodiment, the first interface 28, the first interface control system 30, and the first and second boiler control units 18 and 24 use the RS-232 communication protocol. As with requests, the first interface control system 30 also allows the first interface 28 to instruct the first and/or second boiler units 14 and/or 20 to alter their operating parameters.

As shown in FIG. 10, the first interface control system 30 may be mounted inside the first boiler housing 12. However, the present invention also envisages positioning the first interface control system 30 on the external surface of the first boiler housing 12 or even remote to the housing 12. In an alternative embodiment, the first interface control system 30 may be integral to first boiler control unit 18, the second boiler control unit 24, the first interface 28, or have some functionality divided between any or all of these components.

Figure 3:
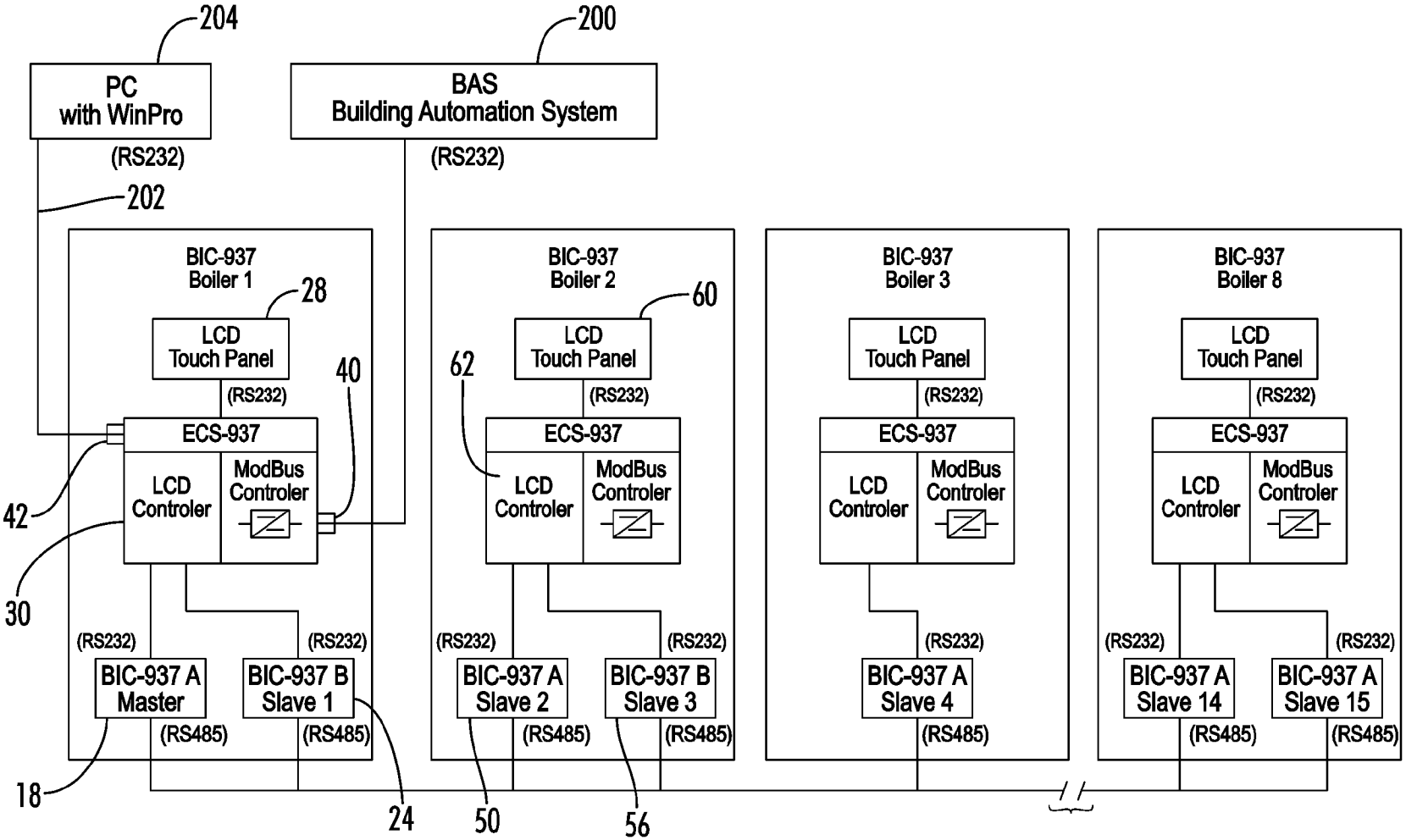
FIG. 3 is a schematic of a boiler assembly having multiple boiler systems.

Now referring to FIG. 3, the first interface control system 30 may also include an external control connector 40 that can be connected to a building automation system or a building management system (BAS or BMS) 200 to allow the first interface control system 30 to communicate with the BMS (which may require communications across the Internet). This permits the BMS to change the operating parameters of the first boiler unit 14, the second boiler unit 20, or both by transmitting operating parameter instructions to the first boiler control unit 18, via the external control connector 40 of the first interface control system 30, and to monitor the status of the first boiler system 10 generally. Preferably, the first interface control system 30 will communicate with the BMS over the ModBus communication protocol. The ModBus protocol is a messaging structure developed by Modicon, Inc. in 1979. It is used to establish master-slave or client-server communication between devices. It is a widely used network protocol in the industrial manufacturing environment. It is also envisioned that the interface control system 30 will communicate with the BMS over Bacnet, Lonworks, and derivative protocols (with ModBus collectively referred to as the BMS/ICS communication protocol).

The first interface control system 30 may also have a PC connector 42. The PC connector 42 allows the first interface control system 30 to communicate across a link 202 to a computer 204, as shown in FIG. 3. Consequently, if certain aspects of the boiler system's operation need to be monitored or changed, that are not accessible through the first interface 28, a computer may be used to affect those aims. It should also be noted that the computer may also provide any or all of the functionality imparted by the first interface 28. Preferably, a cable capable of providing galvanic isolation should be used as the link between the computer and the PC connector 42 (referred to as a galvanic isolation cable). Once such cable is available from Furint.

One significant advantage of the architecture of the present invention is that by providing the first interface control system 30, the boiler system 10 becomes very modular. Because the first interface control system 30 manages the communications between the first interface 28 (or a BMS or computer) and the first and second boiler control units 18 and 24, different interfaces and control units can be readily combined to accommodate distinct boiler unit and interface constructions, arrangements, or configurations (as often needed for different applications) without concern that their will be interoperability issues between them. The interoperability is handled/managed by the first interface control system 30. This modularity reduces the number of variations of boiler control units and interfaces that must be manufactured to accord with different boiler unit and interface configurations/combinations.

This is easily appreciated when one considers that the first interface control system 30 can manage communications between the first interface 28, a computer, and/or a BMS (collectively "external sources") and the first boiler control unit 18. If the first interface control system 30 did not handle these communications then a boiler control unit would have to be manufactured with the capacity to communicate with any or all of these external sources. This would either result in multiple boiler control unit derivatives (one for each external source) or one boiler control unit that could accommodate communications with all external sources. These options are undesirable for many reasons. One such reason being that a single boiler control unit capable of handling all communications would increase the expense and complexity of the control unit (especially if the specific application only involved one external source) and the necessity to have numerous variations of one boiler control unit would not only increase the overall cost, e.g. requiring different assembly lines and component stockpiles, but also increase the inventory and overhead expenses associated with having the many control unit variations on hand. For these reasons, among many others, it is desirable to have the capabilities provided by the first interface control system 30.

Referring to FIGS. 1 and 3, the present invention also provides a second boiler system 15 having a second boiler housing 44, a third boiler unit 46 located in the second boiler housing 44 and having third boiler operating parameters, a third flue gas exit (not shown), and a third boiler control unit 50 operable to control the third boiler unit 46. Also included in the second boiler system 15 and positioned in the second boiler housing 44 is a fourth boiler unit 52. The fourth boiler unit 52 having fourth boiler operating parameters, a fourth flue gas exit (not shown), and a fourth boiler control unit 56 that controls the operation of the fourth boiler unit 52. A second common flue (not shown) is connected to both the third and fourth flue gas exits.

The structure and function of the third and fourth boiler units 46 and 52 is analogous to that of the first and second boiler units 14 and 20 with the following exception: when the first, second, third, and fourth boiler units 14, 20, 46, and 52 are being operated in a cascaded configuration (as described above), the first boiler control unit 18 communicates with the other boiler control units and coordinates the operation of the four boiler units. In other words, the third boiler control unit 50 does not direct the operation of the fourth boiler unit 52 (or vice versa) when the four boiler units are in a cascaded arrangement.

As the first boiler control unit 18 can communicate with the third and fourth boiler control units 50 and 56, the first interface control system 30 is capable of accessing the third and fourth boiler operating parameters, via the first boiler control unit 18. This engenders the first interface control system 30 with the capacity to report a status and/or request changes to the third and fourth boiler operating parameters, the reports or requests emanating from the first interface 28. Further, as a result of the channel provided by the first boiler control unit 18 to the first interface control system 30, and hence the first interface 28, the first interface 28 can display the operational parameters of all four boiler units in one central location. Thus, if a user desires to monitor the operation of the cascaded system in its entirety (all of the boiler units in the cascade), the user may do so through the first interface 28, as illustrated in the exemplary interface screen shot of FIG. 4*d*.

Although, the first interface control system 30 and the first interface 28 permit access to the third and fourth boiler control units 46 and 52, it may also be desirable to have access to these units independent of the first interface control system 30 or the first interface 28, e.g. if the third and fourth boiler units 46 and 52 are at a remote location relative to the first boiler system 10. To this end, the present invention provides a second interface 60 and a second interface control system 62. The second interface control system 62 has the capacity to communicate with the second interface 60, the third boiler control unit 50 and the fourth boiler control unit 56, similarly in operation and function to that between the first interface control system 30, the first interface 28, the first boiler control unit 18 and the second boiler control unit 24. However, the second interface control system lacks the ability to communicate with the first and second boiler control units 18 and 24 (unless the third or fourth boiler control unit 50 or 56 is designated as a "master" as will be discussed below). As with the first interface 28, the second interface 60 may be a LCD touch-screen with the ability to display pictorial representations of the third and fourth boiler operating parameters.

Operation of a Boiler Assembly

Figure 5:
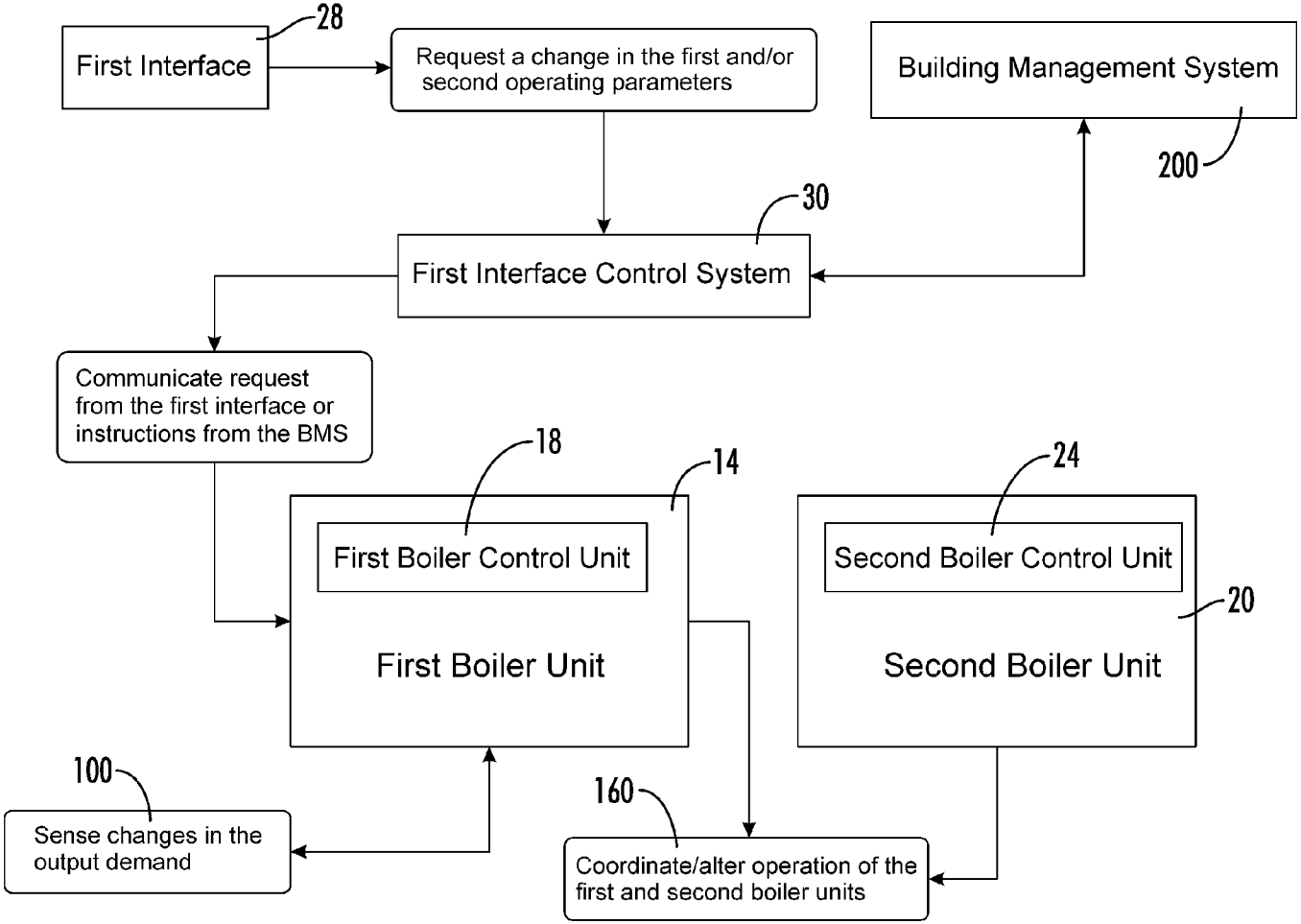
FIG. 5 is a graphical representation of the operation of a boiler system containing two boiler units.
Figure 11:
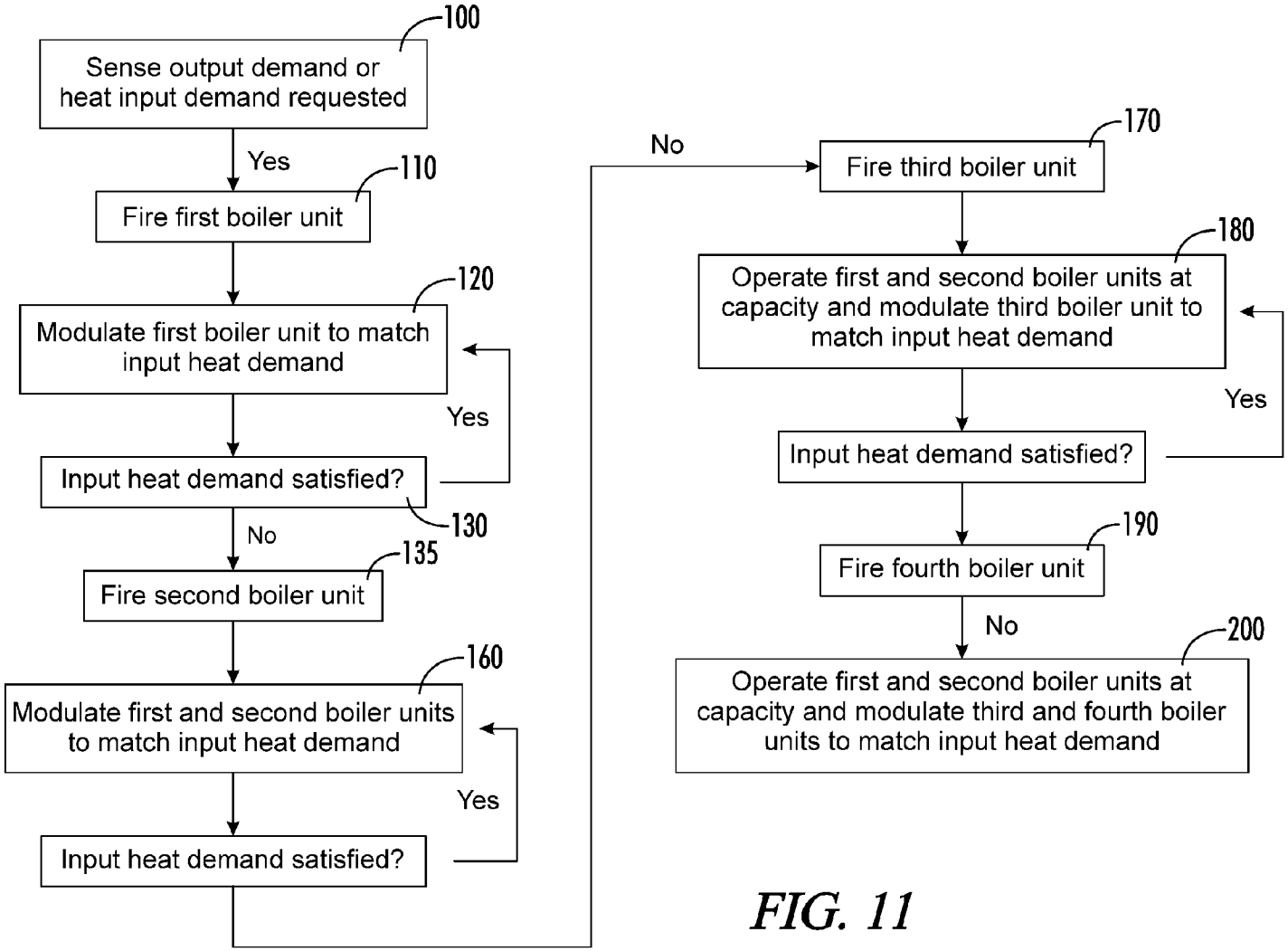
FIG. 11 is a flow chart providing an overview of the operation of one embodiment of the present invention.

Now referring to FIGS. 5 and 11, when the first boiler system 10 and/or second boiler system 15 experience an input heat demand (also referred to as sensing a change in the output demand), step 100, from a water supply system, the first boiler unit 14 is operated in an attempt to meet the demand, step 110. Specifically, after firing, the first boiler control unit 18 modulates the output of the first boiler unit 14 to meet the input heat demand, step 120. As long as the input heat demand is below the output capacity of the first boiler unit 14, only the first boiler unit 14 contributes thermal energy to the water supply system. However, even though the second boiler unit 20 has not been fired, the second boiler blower assembly 64 will be activated, at the direction of the first boiler control unit 18. In other words, if the first boiler unit 14 has fired, the first boiler control unit 18 will activate the second boiler blower assembly 62 regardless or independent of the ignition status (the ignition status referring to whether or not the second burner 66 has fired) of the second boiler unit 20.

Activating the second boiler blower assembly 64, even though the second boiler unit 20 has not fired, prevents reintroduction of exhaust gases from the common flue 26 back into the air inlet(s) (not shown) of the first and/or second boiler units 14 and 20.

Figure 7:
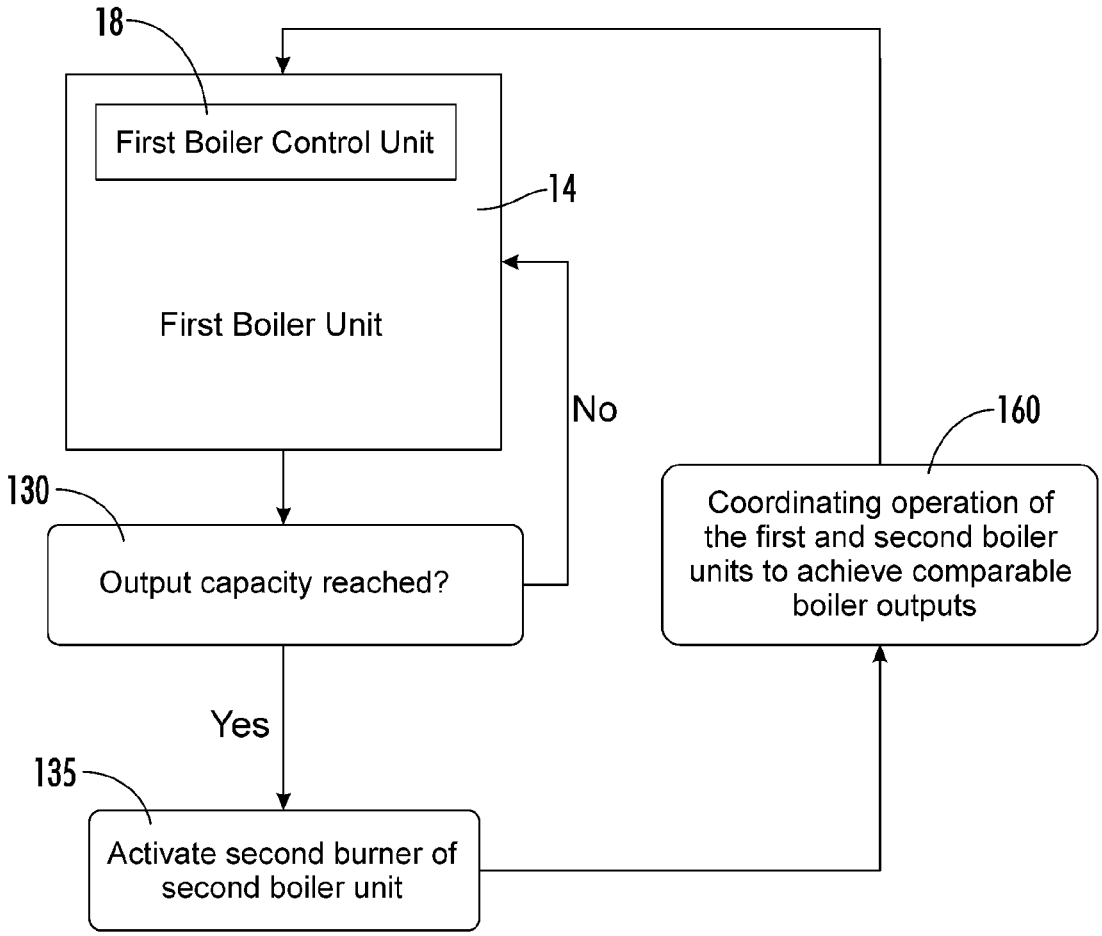
FIG. 7 is a flow chart illustrating the process employed to activate the burner of a second boiler unit and the coordination between first and second boiler units after the burner of the second boiler unit has been fired.

At some predetermined level, as the input heat demand rises, the input heat demand will exceed the output capacity of the first boiler unit 14. Generally, the output capacity can be described as the maximum amount of thermal energy the first boiler unit 14 is capable of delivering to the water supply system. However, the output capacity may also describe a user-defined limitation on the operation of the boiler unit, a limit less than the potential maximum thermal output. When the input heat demand surpasses the output capacity of the first boiler unit 14, the first boiler control unit 18 activates the second burner 66 of the second boiler unit 20, i.e. the second boiler unit 20 fires, steps 130 and 135 in FIGS. 7 and 11. The second boiler unit 20 is only capable of delivering thermal energy to the water supply system after it fires, or alternatively worded, after the second burner 66 is activated. In the preferred embodiment this is accomplished by the first boiler control unit 18 instructing the second boiler control unit 24 to activate the second burner 66. This may be referred to a cascaded operation.

In the arrangement shown in FIGS. 1 and 10, a boiler system 10 with a first boiler unit 14, a second boiler unit 20, and a first common flue 26 connecting the first and second flue gas exits 16 and 22, a difficulty exists in attempting to fire the second boiler unit 20 when the first boiler unit 14 is operating at or over a majority of its output threshold, often the output threshold and the output capacity are the same—but not always. This is a natural result of the aerodynamic disturbances created by the first boiler unit 14 when operating at or above its output threshold, i.e. the first boiler blower assembly 68 generates a significant pressure (or aerodynamic force) and this pressure may be enough to prevent the firing process of the second boiler unit 20 from being effective.

Figure 6:
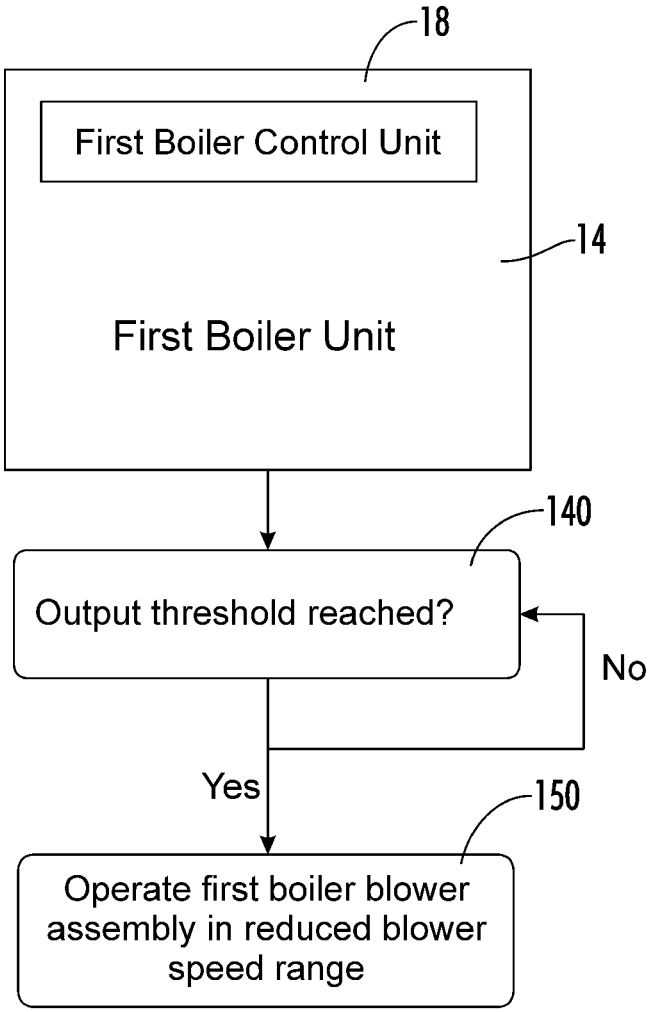
FIG. 6 is a flow chart representing the process used to determine when a blower assembly should be operated in a reduced blower speed range.

To combat this problem, the first boiler blower assembly 68 has a reduced blower speed range at which the aerodynamic force (or pressure) it creates does not inhibit the second burner 66 from firing. In effect, when the first boiler unit 14 reaches its output threshold (step 140), the first boiler blower assembly 68 will be operated in the reduced blower speed range before the second burner 66 is activated, i.e. fired or a change in the ignition status of the second boiler unit 20, (step 150) so that the second burner 66, or the second boiler unit 20 more generally, will not experience ignition blowout. This sequence is depicted in FIG. 6.

If the input heat demand is such that both the first and second boiler units 14 and 20 are fired and supplying thermal energy to the water supply system then the first boiler control unit 18 coordinates the operation of the first and second boiler units to achieve comparable first and second boiler outputs, step 160 in FIGS. 5 and 11. By comparable it is meant that the first boiler control unit 18 attempts to equalize the thermal contributions of the first and second boiler unit 14 and 20. Thus, the first and second boiler units 14 and 20 work in tandem to satisfy the input heat demand.

It should be noted that although the first boiler control unit 18 coordinates the operation of the boiler system 10 as a whole, i.e. it coordinates the operation of both the first and second boiler units 14 and 20, the second boiler control unit 24 directly manages the operation of the second boiler unit 20

(such as controlling the second boiler blower assembly 64 or igniting/firing the second burner 66).

If the first boiler system 10 is unable to meet the needs of the input heat demand, then a second boiler system 15 having third and fourth boiler units 46 and 52 will be introduced. Alternatively stated, if the first and second boiler units 14 and 20 are operating at capacity and cannot satisfy the input heat demand then the second boil system 15 will be brought into the cascade to assist. In this scenario the first boiler control unit 18 will direct the operation of the third and/or fourth boiler units 46 and 52 much as it does with the second boiler unit 20. Specifically, if the required input heat demand cannot be met by the first and second boiler units 14 and 20, then the first boiler control unit 18 will instruct the third boiler unit 46 to fire, or instruct the third boiler control unit 50 to activate/fire the third burner (not shown), step 170.

With the first boiler system 10 operating at its maximum output, the first boiler control unit will modulate the third boiler unit 46 to match the requirements of the input heat demand, step 180. If the input demand cannot be satisfied by the first, second, and third boiler units 14, 20, and 46, then the first boiler control unit 18 will instruct the fourth boiler unit 52 to fire, or instruct the fourth boiler control unit 56 to activate/fire the fourth burner (not shown), step 190.

The sequence employed during the firing of the fourth boiler unit 52 is analogous to that used when the second boiler unit 20 is fired (i.e. operating the first boiler blower assembly 68 in the reduced blower speed range during a change in the ignition status of the second burner 66). Namely, the third boiler blower assembly 74 will operate in a reduced blower speed range during the firing process for the fourth boiler unit 52 to prevent ignition blowout of the fourth burner.

Once both the third and fourth boiler units 46 and 52 have been fired, the first boiler control unit 18 coordinates the operation of the boiler units to achieve a comparable thermal output between them. The first boiler control unit 18 will also modulate the third and fourth boiler units 46 and 52 in unison in response to changes in the input heat demand, step 200. Note that if the second boiler system 15 is contributing thermal energy to the water supply system, the first boiler system 10 will be operating at capacity and as long as the input demand exceeds the capacity of the first system 10, the first boiler control unit will respond to changes in the input heat demand by modulating the operation of the second boiler system 15 (or only the third boiler unit 46 if the third boiler unit 46, by itself, is capable of meeting the input heat demand in excess of the capacity of the first boiler system 10.) Thus, the first boiler control unit 18 coordinates the operation of all four boiler units to meet the input heat demand of the water supply system.

Conversely, if all four boiler units are operating, and the input heat demand falls to a level within the capacity of the first, second, and third boiler units 14, 20, and 46 then the first boiler control unit 18 will instruct the fourth boiler unit 52 to cease its thermal contributions. Resultantly, the first boiler system 10 will operate at capacity and the first boiler control unit 18 will modulate the third boiler unit 42 to accommodate changes in the input heat demand. Moreover, if the input heat demand falls further still, the first boiler control unit 18 will instruct the third boiler unit 42 to shut down, i.e. stop its thermal contributions, and the first boiler control unit 18 will coordinate the efforts of the first and second boiler units 14 and 20. Finally, if the input heat demand falls within the capacity of the first boiler unit 14, the first boiler control unit 18 will shut down the second boiler unit 20 and service the input heat demand with only the efforts of the first boiler unit 14. In this way the cascade operation of the boiler units is bi-directional or reversible.

Figure 8:
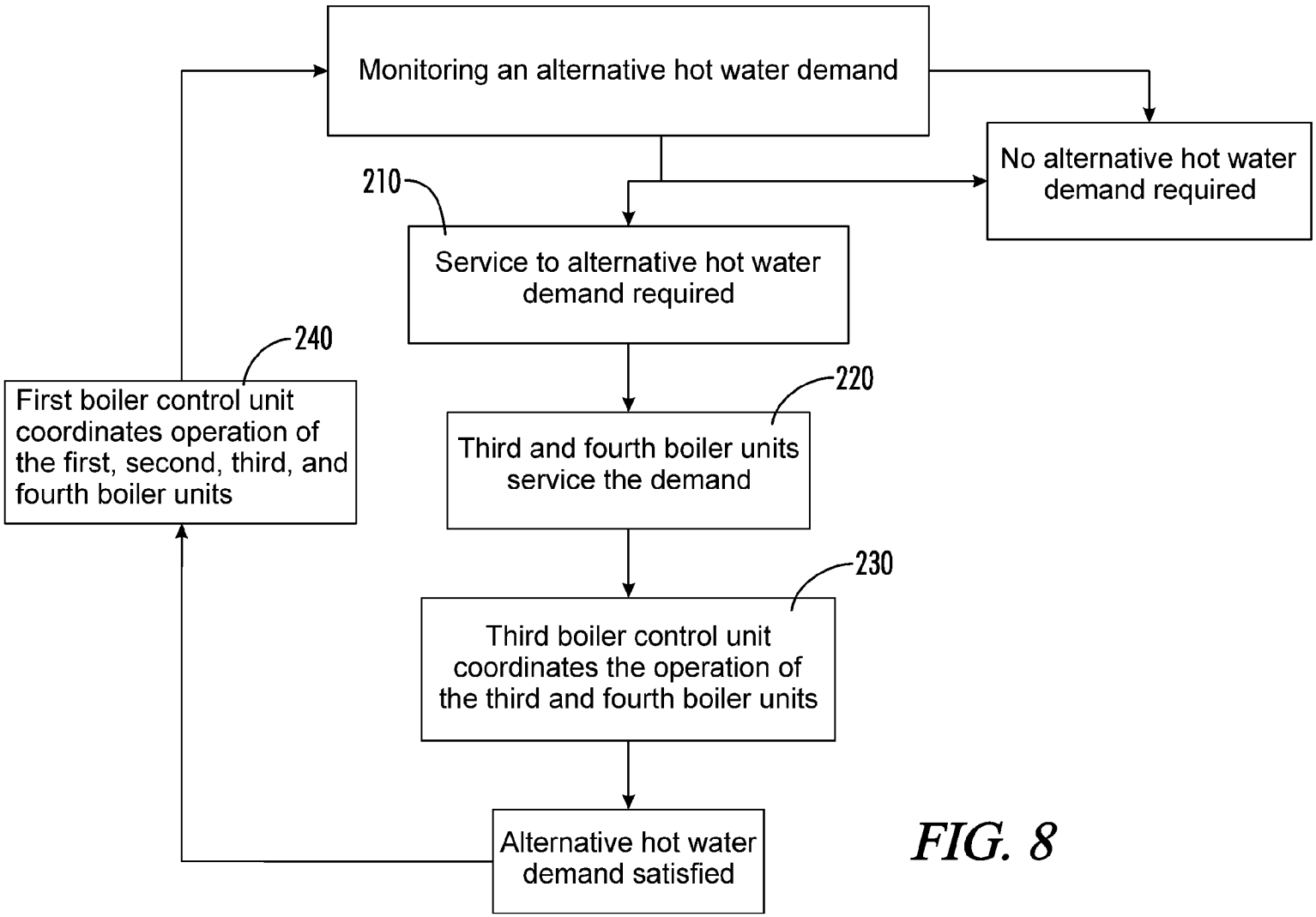
FIG. 8 is a flow chart representing the process used to service an alternative hot water demand.

Now referring to FIG. 8. There may also be situations where one of the boiler systems 10 or 15 is expected to service an alternative hot water demand such as an indirect domestic hot water tank. Consider that the second boiler unit 15 is called upon to service an alternative hot water demand. When the alternative hot water demand is received (step 210), the second boiler system 15 will remove itself from the cascade (step 220). When this occurs, the first boiler control unit 18 will no longer be able to direct the operation of the second boiler system 15. Instead, the third boiler control unit 50 will function to coordinate the operation of the third and fourth boiler units 46 and 52, although the present invention also envisions the fourth boiler control unit 56 taking the leading role. The third boiler control unit 50 will function to control the operation of the second boiler system 15 much as first boiler control unit 18 functions to control/coordinate the operation of the first boiler system 10 (step 230). After the alternative hot water demand has subsided, the second boiler system 15 will return to the cascade and subject itself to the control of the first boiler control unit 18 (step 240).

The present invention also permits the first boiler system 10 to service the alternative hot water demand. In this scenario, the first boiler control unit 18 will not only direct the operation of the first boiler system 10 to service the alternative hot water demand but will continue to control and manage the operation of the second boiler system 15.

The preceding discussion has focused on the ability of the first boiler control unit 18 to coordinate the operation of the first, second, third, and/or fourth boiler units 14, 20, 46, and 52. However, the present invention also provides the ability to select which control unit in a cascade or boiler system (if only one boiler system is in the cascade) manages and coordinates the efforts of all of the other boiler units. In one preferred embodiment, this is affected by utilizing the interface associated with a particular boiler system to assign the control units in that boiler system a control system identity or role, for example master or slave. If a control unit is designated a master then it has the ability to manage and coordinate the efforts of the other boiler units. Specifically, the first boiler unit 14 has a first boiler control unit identity, the second boiler unit 20 has a second boiler unit identity and the first and second boiler unit identities can be assigned through the first interface 28. Further, the third boiler unit 46 has a third boiler control unit identity, the fourth boiler unit 52 has a fourth boiler unit identity and the third and fourth boiler unit identities can be assigned through the second interface 60.

In the above discussion, the first boiler control unit 18 has been acting as the master. However, utilizing the interface, or the BMS or another external source, one could designate the second, third, or fourth control units 24, 50, or 56 as the master. The control units not designated as a master will be designated as slaves. It is also within the scope of the invention that the control units could automatically assign control system identities to themselves. The control unit designated as the master would coordinate all of the boiler units unless a boiler system was called on to service an alternative hot water demand. In this case one control unit from the boiler system called on to service the alternative hot water demand would designate itself (or would be pre-designated) to manage the boiler system until the boiler system returned to the cascade.

Although the above discussion has focused on one or two boiler systems (each boiler system having two boiler units), the present invention also envisions a bank of three or more cascaded boiler systems/units working to satisfy the input heat demand of a large water supply system.

Thus it is seen that the apparatus and methods of the present invention readily achieve the ends and advantages mentioned as well as those inherent therein. While certain preferred embodiments of the invention have been illustrated and described for purposes of the present disclosure, numerous changes in parts and steps may be made by those skilled in the art, which changes are encompassed within the scope and spirit of the present invention as defined by the appended claims.

What is claimed is:

1. A method to control a boiler assembly, comprising:

(a) providing a boiler assembly having an output demand; a first boiler housing; a first boiler unit located in the first boiler housing with first boiler operating parameters, a first flue gas exit, and a first boiler control unit operable to control the first boiler unit; a second boiler unit located in the first boiler housing with second boiler operating parameters, a second flue gas exit, and a second boiler control unit operable to control the second boiler unit and wherein the first boiler control unit is operable to control the second boiler control unit; a first common flue connected to both the first flue gas exit and the second flue gas exit; a first interface; and a first interface control system operable to communicate with the first boiler control unit, the second boiler control unit, and the first interface;

(b) sensing changes in the output demand;

(c) coordinating operation of the first and second boiler units, via the first boiler control unit, in response to the changes in the output demand;

(d) communicating a request from the first interface to the first boiler control unit, via the first interface control system, to alter the first and second boiler unit operating parameters; and (e) altering the first and second boiler unit operating parameters in response to the request.

2. The method of claim 1, further comprising:

communicating with a building automation system through an external control connector on the first interface control system.

3. The method of claim 1, wherein:

in step (a) the first boiler unit has a first boiler blower assembly with a reduced blower speed range and the second boiler unit includes an ignition status;

the method further comprising:

monitoring an output threshold of the first boiler unit; and after the first boiler unit has reached the output threshold, operating the first boiler blower assembly in the reduced blower speed range before changing the ignition status of the second boiler unit and thereby preventing ignition blowout of the second boiler unit.

4. The method of claim 1, further comprising:

monitoring an output capacity of the first boiler unit, and activating a second burner of the second boiler unit after the output capacity of the first boiler unit has been reached.

5. The method of claim 4, further comprising:

after the second burner has been activated, coordinating operation of the first and second boiler units to achieve comparable boiler outputs.

6. The method of claim 1, further comprising:

providing a second boiler housing; a third boiler unit located in the second boiler housing and having third boiler operating parameters, a third flue gas exit, and a third boiler control unit operable to control the third boiler unit; a fourth boiler unit located in the second boiler housing and having fourth boiler operating parameters, a fourth flue gas exit, and a fourth boiler control unit operable to control the fourth boiler unit; and a second common flue connected to both the third flue gas exit and the fourth flue gas exit; and wherein the first boiler control unit is operable to communicate with the third boiler control unit and the fourth boiler control unit; and coordinating operation of the first, second, third, and fourth boiler units, via the first boiler control unit.

7. The method of claim 6, further comprising:

monitoring an alternative hot water demand;

servicing the alternative hot water demand via the third and fourth boiler units; and during the servicing step, controlling the fourth boiler control unit via the third boiler control unit to coordinate operation of the third and fourth boiler units.

8. The method of claim 6, further comprising:

providing a second interface and a second interface control system operable to communicate with the third boiler control unit, the fourth boiler control unit, and the second interface; and communicating requests from the second interface to the second interface control system to report the third and fourth boiler operating parameters.

9. The method of claim 6, further comprising:

monitoring an alternative hot water demand;

servicing the alternative hot water demand via the first and second boiler units;

coordinating operation of the first and second boiler units via the first boiler control unit to service the alternative hot water demand; and during the servicing step, controlling the third and fourth boiler control units via the first boiler control unit to coordinate operation of the third and fourth boiler units.

* * * * *